US011407192B2

(12) United States Patent
Poggenpohl

(10) Patent No.: US 11,407,192 B2
(45) Date of Patent: Aug. 9, 2022

(54) HYDRAULIC EXTRUSION PRESS AND METHOD FOR OPERATING A HYDRAULIC EXTRUSION PRESS

(71) Applicant: SMS group GmbH, Duesseldorf (DE)

(72) Inventor: Klaus Poggenpohl, Langenfeld (DE)

(73) Assignee: SMS group GmbH, Duesseldorf (DE)

( * ) Notice: Subject to any disclaimer, the term of this patent is extended or adjusted under 35 U.S.C. 154(b) by 119 days.

(21) Appl. No.: 14/399,579

(22) PCT Filed: May 10, 2013

(86) PCT No.: PCT/DE2013/000257
§ 371 (c)(1),
(2) Date: Nov. 7, 2014

(87) PCT Pub. No.: WO2013/167111
PCT Pub. Date: Nov. 14, 2013

(65) Prior Publication Data

US 2015/0090132 A1 Apr. 2, 2015

(30) Foreign Application Priority Data

May 10, 2012 (DE) ..... 10 2012 009 182.6

(51) Int. Cl.
*B30B 1/32* (2006.01)
*B21C 31/00* (2006.01)
*B21C 23/21* (2006.01)

(52) U.S. Cl.
CPC ..... *B30B 1/32* (2013.01); *B21C 23/211* (2013.01); *B21C 31/00* (2013.01)

(58) Field of Classification Search
CPC ..... B30B 1/32; B30B 15/22; B30B 15/161; B30B 15/163; B21C 23/211; B21C 31/00; B29C 48/252
(Continued)

(56) References Cited

U.S. PATENT DOCUMENTS 3,172,261 A * 3/1965 Govan ..... F15B 11/02 60/327
3,649,816 A * 3/1972 Johnes ..... B21C 31/00 700/206
(Continued)

FOREIGN PATENT DOCUMENTS

CN 1803448 A 7/2006
CN 201043539 Y 4/2008
(Continued)

OTHER PUBLICATIONS

Kickback valve definition and purpose. google.com—Kickback valve purposes.*
(Continued)

*Primary Examiner* — Shelley M Self
*Assistant Examiner* — Smith Oberto Bapthelus
(74) *Attorney, Agent, or Firm* — Collard & Roe, P.C.

(57) ABSTRACT

A hydraulic extrusion press includes at least one ram, the ram being driven by hydraulic oil from a main line and a hydraulic control pressure being used to control the extrusion press. To minimize non-productive periods, the control pressure is also supplied to the main line. The main line and the pressure control system are connected with one another on the pressure side.

26 Claims, 6 Drawing Sheets

(58) Field of Classification Search
USPC ..... 100/35; 72/453.02, 453.06; 425/376.1, 425/149
See application file for complete search history.

(56) References Cited

U.S. PATENT DOCUMENTS

| | | | | |
|---|---|---|---|---|
| 4,827,753 | A * | 5/1989 | Moroney | B21D 11/02 72/296 |
| 7,421,874 | B2 * | 9/2008 | Claasen | B30B 1/323 72/253.1 |
| 2013/0098459 | A1 * | 4/2013 | Opdenbosch | E02F 9/2217 137/2 |
| 2014/0096581 | A1 * | 4/2014 | Yakushigawa | B21C 23/211 72/271 |

FOREIGN PATENT DOCUMENTS

| | | | | |
|---|---|---|---|---|
| CN | 201190703 | Y | 2/2009 | |
| CN | 201988582 | U | 9/2011 | |
| DE | 28 14 525 | A1 | 10/1978 | |
| DE | 692 12 549 | T2 | 2/1997 | |
| EP | 0 027 743 | A1 | 4/1981 | |
| EP | 0027743 | A1 * | 4/1981 | F15B 11/02 |
| EP | 0027743 | B1 * | 5/1985 | F15B 11/02 |
| GB | 1 566 617 | A | 5/1980 | |
| JP | 0027743 | A1 * | 4/1981 | F15B 11/02 |
| JP | S60-183118 | A | 9/1985 | |
| JP | S61-171902 | A | 8/1986 | |
| JP | 2010-144840 | A | 7/2010 | |

OTHER PUBLICATIONS

Throttle valve definition and purpose. Merrian-webster.com—throttle valve definition and purpose.*
German Office Action in DE 10 2012 009 182.6, dated Mar. 25, 2013, with English translation of relevant parts.
Chinese Office Action in 201380036695.2, dated Aug. 3, 2015.
International Search Report of PCT/DE2013/000257, dated Oct. 1, 2013.
Notification of Reason for Refusal in JP 2015-510644, dated Jan. 19, 2016.
Wikipedia, Liste der Schaltzeichen (Fluidtechnik), https://de.wikipedia.org/wiki/Liste_der_Schaltzeichen_(Fluidtechnik), downloaded Aug. 9, 2021, 12 pages.
Wikipedia, Direction Control Valve, https://en.wikipedia.org/wiki/Directional_control_valve, downloaded Aug. 9, 2021, 4 pages.
Wikipedia, Flow Control Valve, https://en.wikipedia.org/wiki/Flow_control_valve, downloaded Aug. 9, 2021, 3 pages.

* cited by examiner

HYDRAULIC EXTRUSION PRESS AND METHOD FOR OPERATING A HYDRAULIC EXTRUSION PRESS

CROSS REFERENCE TO RELATED APPLICATIONS

This application is the National Stage of PCT/DE2013/000257 filed on May 10, 2013, which claims priority under 35 U.S.C, § 119 of German Application No. 10 2012 009 182.6 filed on May 10, 2012, the disclosure of which is incorporated by reference. The international application under PCT article 21(2) was not published in English.

BACKGROUND OF THE INVENTION

1. Field of the Invention

The invention relates to hydraulic extrusion presses having a main hydraulic line that drives at least one ram as the main consumer, and having a hydraulic control pressure system. Likewise, the invention relates to a method for operation of a hydraulic extrusion press having at least one ram, in which at least the ram is driven by means of hydraulic oil from a main line, and a hydraulic control pressure is used for control of the extrusion press.

2. Description of the Related Art

Such extrusion presses are sufficiently known from the state of the art, whereby extrusion as such is a forming method in which heavy metal blocks or light metal blocks, also called bolts, preferably preheated, are pressed through a die or through a matrix, using a hydraulic ram, to produce strand-like semi-finished products, generally called profiles.

The common hydraulic drives for the ram of these presses consist of a machine-dependent number of main pumps, which can be switched on as needed, by way of line valves for different consumer groups, such as multiple cylinders, for example, in which pistons for the hydraulic ram run.

By means of corresponding pump switching and consumer circuits, one axle, in each instance, can be driven at the same time with individual axles of other consumer groups. In this connection, it is generally possible to interconnect pumps on the different lines, whereby the movement sequences and speeds are defined and controlled by way of the pump assignment and the related conveying stream regulation of the pumps. Extrusion presses are built for different pressing forces, at the present time in a spectrum between approximately 10 MN and approximately 150 MN. Different pressing forces and therefore pressing pressures result from the tool geometry or profile geometry and the pressing method, for the machine size, in each instance, and thereby different method pressures for the main axles outside of the pressing process occur.

For this reason, hydraulic extrusion presses generally have a separate control pressure system, in order to ensure that a corresponding control pressure is available at all times, for example for a valve controller or pump drives, with sufficient operational reliability.

SUMMARY OF THE INVENTION

In this connection, it is understood that non-productive periods are unavoidable during backward movement of a ram and when loading a new block or bolt, or during other setup activities, during which times a corresponding extrusion press is not productive. Accordingly, it is the task of the present invention to minimize the non-productive periods.

As a solution, a hydraulic extrusion press of the stated type and a method of the stated type, for operation of a hydraulic extrusion press, having the characteristics according to the invention are proposed.

In this connection, for example, non-productive periods can be reduced by means of a hydraulic extrusion press having a main hydraulic line that drives at least one ram as the main consumer, and having a hydraulic control pressure system, which press is characterized in that the main line and the control pressure system are connected with one another on the pressure side, because oil from the control pressure system or control oil is also available, under certain circumstances, particularly if large oil volume streams are required in the main line.

Accordingly, the non-productive periods can also be reduced by means of a method for operation of a hydraulic extrusion press having at least one ram, in which at least the ram is driven by means of hydraulic oil from a main line, and a hydraulic control pressure is used to control the extrusion press, and which method is characterized in that the control pressure is also applied to the main line.

In this connection, one particularly proceeds from the main recognition that non-productive periods, as such, can also be reduced by means of an increase in the total output of an extrusion press, in that larger and longer blocks or bolts, in particular, can be pressed. This accordingly leads to a proportional reduction in the non-productive periods, whereby here, however, the control pressure pumps, as a function of the pressing cycles, over long phases, merely continue to serve for balancing out leakage oil losses and, for the remainder, swinging back to a low conveying stream, so that they are utilized only slightly. The latter is reinforced even more in the case of a design of extrusion presses toward larger or longer blocks or bolts, whereby ultimately, corresponding lower dimensioning of the control pressure pumps is possible only in very limited manner, for reasons of operational reliability, because the required control pressures must be available at all operation times.

The use of control oil in backward movements, for example, where large volumes generally have to be moved at low pressures, can lead to non-productive period reductions between 0.5 and 0.8 seconds or more—even in the case of a careful estimate as has already been shown in experiments. It is assumed that even in the case of other movement sequences, further reductions in the non-productive periods can be achieved, so that in this regard, noteworthy reductions of the total non-productive periods can be achieved, particularly without having to increase the overall design of the extrusion press, particularly with regard to its performance characteristics, in noteworthy manner, which is relatively advantageous, particularly also with regard to the costs for an extrusion press equipped in corresponding manner, because ultimately, only relatively cost-advantageous additional components, such as, for example, a supplemental connection line and possible valves or temporary storage devices for oil have to be used.

In this regard, the non-productive periods can be shortened without an increase in the drive power required or to be kept on hand for the pressing process, and this is accordingly cost-advantageous.

Preferably—as is already known from the state of the art—the main line is volume-regulated, so that the volume streams, precisely required for operation of the extrusion press, within the shortest possible period of time, can be made available in operationally reliable manner.

Cumulatively or alternatively to this, the control pressure system is preferably pressure-regulated or the control pressure is preferably kept above a minimum pressure, so that the required control pressure is always reliably available. The minimum pressure preferably lies at 80%, preferably minimally at 90% of the required control pressure, in order to reliably allow control in this manner. It is understood that the pressures in the overall system are limited to maximal pressures in known manner, in order to be able to prevent damage to the hydraulic system, in operationally reliable manner.

In this connection, it should be mentioned that the main cylinders, as already mentioned, side cylinders, sensor cylinders or a table slide, for example, can be provided as main consumers in the main line. Likewise, hydraulic motors, for example for spindle drives, or the like can be driven accordingly, by way of the main line.

In this connection, the different main consumers are preferably coupled with one another by way of consumer groups or consumer controllers, so that accordingly, group-based response is also possible. In this connection, it is understood that the consumer groups or controllers can be individually or jointly supplied with hydraulic oil by the corresponding main pumps, which can easily be implemented by means of accordingly switched line valves, in known manner.

Valve controls or hydraulic pumps, but also secondary consumers, which require relatively small volume streams, can easily be driven by way of the control pressure system—as is already known from the state of the art. Corresponding secondary consumers can be, for example, block or bolt loaders or block or bolt loading grippers or the like. Likewise, release pressures or the like can be applied at suitable locations by way of the control pressure system or by way of the control pressure.

Application of control pressure to the main line can particularly take place by way of proportional volume stream control. In this way, it can particularly be ensured that the control pressure does not drop suddenly, as the result of being applied to the main line and that the control pressure system remains manageable in every operating situation. Preferably, for this purpose, means for proportional volume stream control are provided between the main line and the control pressure system, in the direction of the main line, such as, for example, suitable throttles or pressure compensators.

Impermissible feedback of volume stream from the main line into the control pressure system is prevented by at least one kickback valve having an opening direction directed toward the main line.

Hydraulic oil can be stored in one or more storage devices and applied to the main line from this storage device, these storage devices or one of these storage devices by way of the control pressure. In this way, the oil volume that can be made available by way of the control pressure can be significantly increased, particularly because the storage device can be emptied into the main line even to below the control pressure, if the overall hydraulic system has been suitably designed, so that significant oil volumes can be made available to the main line by way of this storage device, which volumes can be advantageously utilized for a reduction in non-productive periods, particularly in the case of reverse strokes or similar movement sequences that take place under low pressure.

Preferably, hydraulic oil is only stored in the storage device, preferably in a separate storage device, starting from a minimum control pressure, i.e. a storage pressure, so that maintaining the required control pressure is ensured in primary manner.

In a concrete implementation, it is accordingly advantageous if the control pressure system is connected with a storage device. In this manner, the storage device can particularly be filled with oil during those times when the control pressure pump or control pressure pumps merely serve(s) to balance out leakage oil losses or are under less stress. It is true that this oil can also be used, accordingly, as a supply for the control pressure system. Particularly, however, it is advantageous if at least parts of the oil stored in the storage device of the control pressure system are also made available to the main line, under corresponding operating conditions.

In order to guarantee the latter easily and with minimal losses, it is advantageous if at least one storage device is disposed in a connection line between the main line and the control pressure system.

The storage device, in particular, can be disposed between a pressure sequencing valve in the direction toward the pressure control system, in the connection line, on the one hand, as well as means for proportional volume stream control and/or a kickback valve in the direction toward the main line, on the other hand. By means of the pressure sequencing valve, it can be guaranteed that such a storage device is filled with oil from the pressure control system only starting from specific pressures, while oil can then be made available to the main line from the storage device, as has already been described above, whereby if applicable, not only the storage device but also the control pressure system can be secured against volume streams from the main line accordingly, by way of the kickback valve.

It is understood that the characteristics of the solutions described above and in accordance with the invention can also be combined, if applicable, in order to be able to implement the advantages cumulatively, accordingly.

BRIEF DESCRIPTION OF THE DRAWINGS

Further advantages, goals, and properties of the present invention will be explained using the following description of exemplary embodiments, which are particularly shown also in the attached drawing. The drawing shows.

DETAILED DESCRIPTION OF THE PREFERRED EMBODIMENTS

Figure 1:
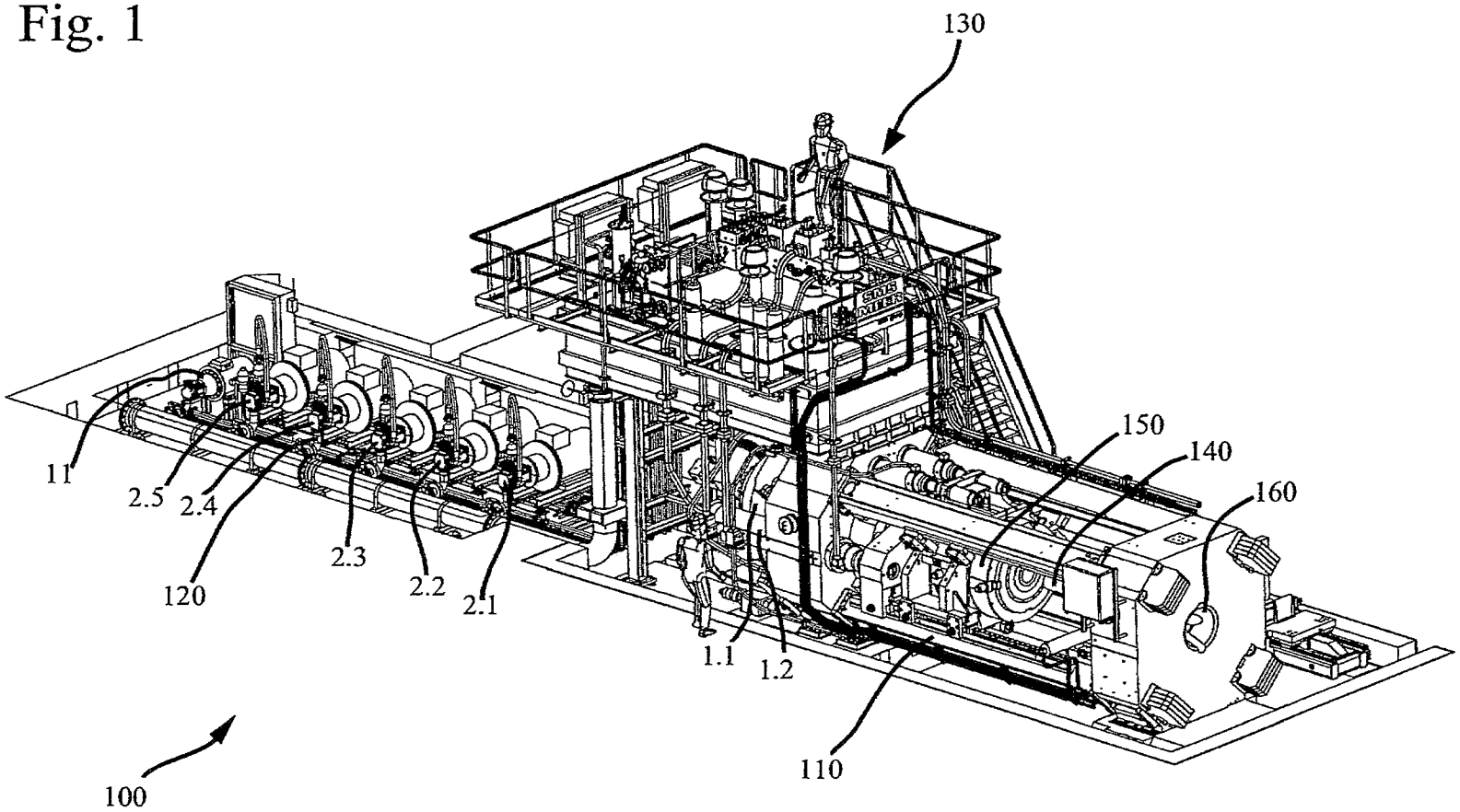
FIG. 1 a perspective view of a hydraulic extrusion press.

The hydraulic extrusion press 100 shown in FIG. 1 comprises a press part 110 and a pump table 120 having five main pumps 2. The press part 110 comprises a main cylinder 1.1 and multiple secondary cylinders 1.2, with which a ram 200 can be moved. For pressing, a block or bolt 140 is loaded into a hydraulically moved block holder 150, by means of a block loader, which is not shown but also known, before the ram 200 presses the block or bolt through a matrix, and the work piece leaves the hydraulic extrusion press 100 through an opening 160.

As is directly evident, the hydraulic extrusion press 100 is a relatively large system, which is operated by way of a hydraulic controller 130.

The hydraulic controller 130 can be implemented in different ways, whereby corresponding exemplary embodiments, which are, however, exemplary for only two main pumps 2, are shown in FIGS. 2 to 6. The latter pumps drive main consumers 1, which are, in these exemplary embodiments, the cylinders 1.1 and 1.2 for the ram 200, a hydromotor 1.3 for a spindle drive, and a cylinder 1.4 for a sensor, but in other exemplary embodiments can also comprise a table displacement or other units, by way of main pumps 2, whereby in FIGS. 2 to 6, a first main pump 2.1 and a second main pump 2.2 are shown, in each instance, which pumps can be applied hydraulically, in each instance, by way of line valves 3, namely a first line valve 3.1 and a second line valve 3.2, to the main consumers 1, which can be activated by means of consumer controllers 4.

In this connection, these exemplary embodiments have a first consumer controller 4.1, in which the two cylinders 1.1 and 1.2 for the ram 200 are combined, as well as a second consumer controller 4.2, in which the hydromotor 1.3 as well as the sensor cylinder 1.4 are combined.

By means of the grouping into consumer controllers 4, the grouped main consumers, in each instance, can easily be synchronously supplied with hydraulic oil, accordingly. In this connection, it is understood that the main consumers 1, in each instance, can be combined into further consumer controllers 4 in any desired manner.

As is directly evident, both main pumps 2 can be optionally applied to both consumer controllers 4 by way of the line valves 3.

In a concrete implementation, the two main pumps 2 are pumps having the same construction, which is driven, in each instance, by way of a corresponding 200 kW motor, and have a conveying stream controller Q (quantity) for volume stream 201. In general, multiple pumps having the same construction are switched in parallel, accordingly, depending on the required overall power, whereby the number of main pumps 2 does not necessarily have to correspond to the number of consumer controllers 4. In other embodiments, the pumps and corresponding motors can be dimensioned differently, for example can be up to 1,000 kW pumps and motors or even larger, whereby in general, an optimum can be found as a function of the required power and the costs connected with this. It is understood that the number of main pumps 2, of line valves 3, and of consumer controllers 4 can be adapted to the concrete requirements, in each instance.

Hydraulic main lines 5 lead to the consumer controllers 4, in each instance, whereby it is understood that here, if applicable, multiple or further main lines 5 can also be provided.

The consumer controllers 4 empty into a container, in known manner, from which in turn the main pumps 2 are supplied in known manner, whereby here, filtering processes or the like can be provided, if applicable.

A control pressure system is also supplied from a corresponding container, preferably from the same container, by way of the control pressure pump 11, which makes control pressure available at 4.3 by way of control oil, for valve control or also for release processes, for example, particularly by means of great startup or tear-away pressures, as well as for secondary consumers, such as block loaders or block loading grippers, for example, which have a small volume consumption. In this connection, a 90 to 100 kW pump or a pump having a 90 to 100 kW motor is used in this exemplary embodiment, the control oil regulation p (pressure) of which takes place by way of pressure. In this manner, it can be ensured that sufficient control pressure for reliable operation of the valves is available at all points in time. It is understood that —depending on the concrete implementation — other power values for the control pressure pump 11 or further control pressure pumps can also be provided.

Figure 2:
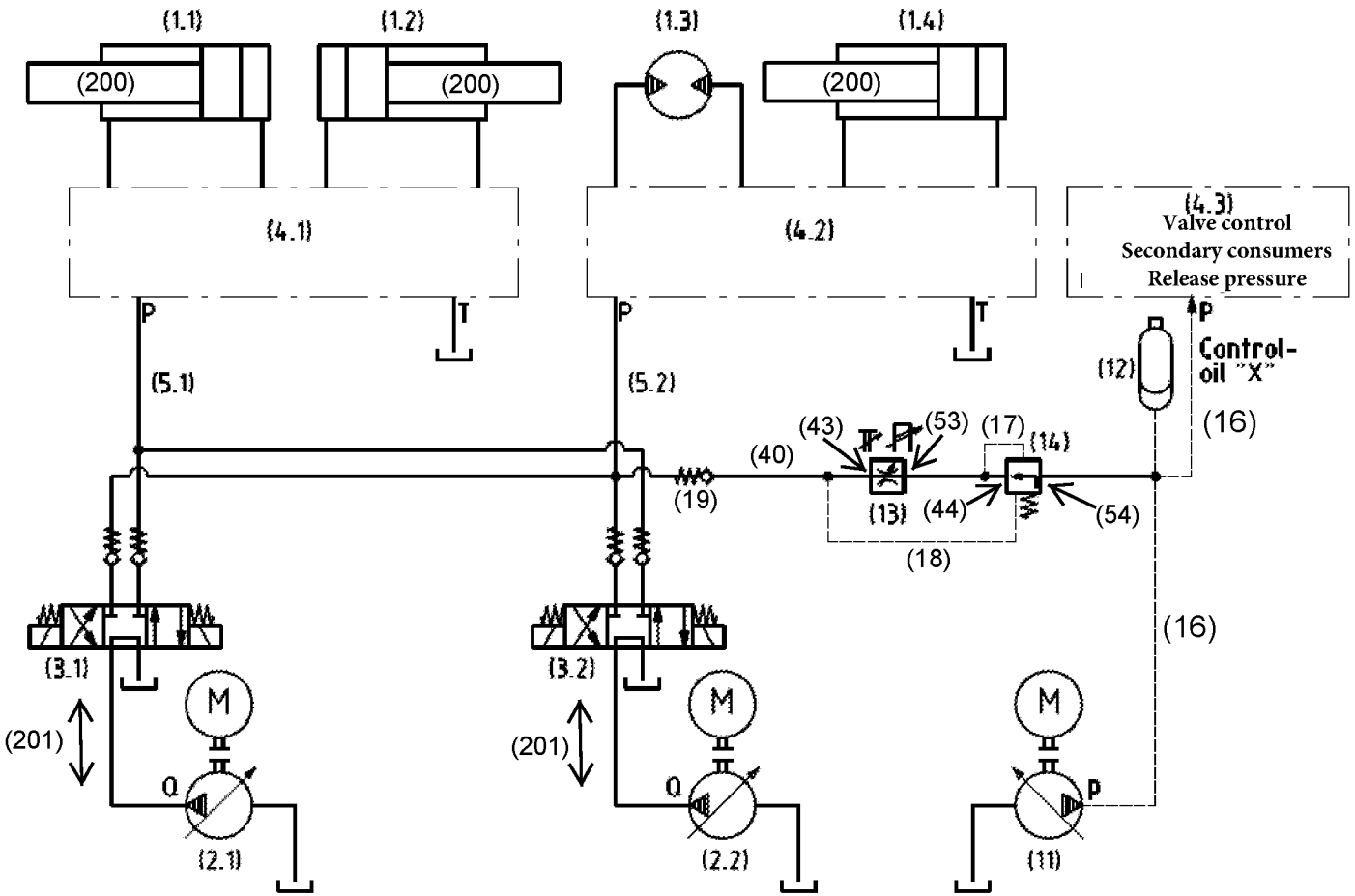
FIG. 2 a schematic representation of details of a first hydraulic system for an extrusion press essential for an explanation of the invention.

In the exemplary embodiment shown in FIG. 2, the control pressure system is connected via control lines 16 with the hydraulic main line 5.2 by way of a connection line 40, whereby means for proportional volume control are provided in this connection line 40, which comprise a throttle 13, in this embodiment, in concrete terms, a manual or proportional throttle and a two-way pressure compensator 14. The throttle 13 has a main line side 43 and a control line side 53. The two-way pressure compensator 14 has a main line side 44 and a control line side 54. Furthermore, a kickback valve 19 is provided in the connection line 40 on the main line side 43 of the throttle 13, which valve prevents kickback in the direction of the control pressure system. In order to be able to utilize the power of the control pressure pump 11 as completely as possible, furthermore a hydraulic storage device 12 is provided, in which hydraulic oil of the control pressure system can be temporarily stored and called up as needed. The two-way pressure compensator 14 is connected with the connection line 40 on the main line side 44 of the two-way pressure compensator 14 by linking lines 17, 18 for controlling the two-way pressure compensator.

As is directly evident, it is possible, in this manner, to allow the control pressure pump 11 to convey into the hydraulic storage device 12 even during times of low conveying output, in order to make the corresponding volume available to the main consumers 1. At the given power defaults, five 200 kW motors for the main pumps 2 and an approximately 100 kW motor for the control pressure pump, approximately one-tenth more power can certainly be made available in this way, in order to have more conveying volume of hydraulic oil available, which can then be made available, in particular, for volume-intensive movements.

Figure 3:
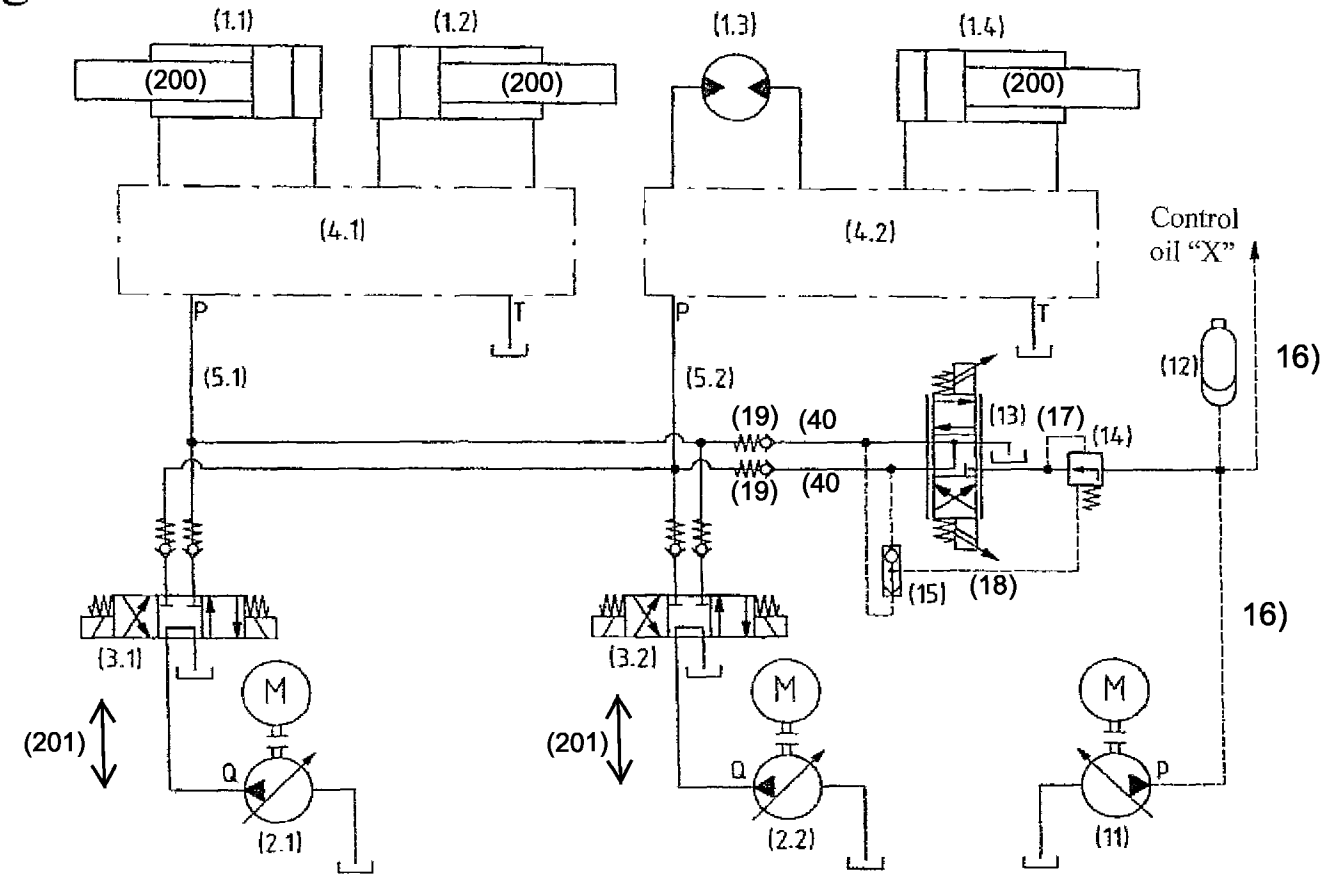
FIG. 3 a schematic representation of details of a second hydraulic system for an extrusion press essential for an explanation of the invention.

While the throttle 13 is configured as a manual or proportional throttle in the exemplary embodiment shown in FIG. 2, the exemplary embodiment shown in FIG. 3 has an electrical proportional directional control valve as the throttle 13, so that not only the first main line 5.1 but also the second main line 5.2 which are connected with the control lines 16 can be impacted with control pressure or hydraulic oil from the control pressure system, accordingly. For this purpose, each of the corresponding connection lines 40, 40 is connected with a kickback valve 19, 19, and an alternating valve 15 is provided between the two connection lines 40, 40 to the two main lines 5, which valve acts on the two-way pressure compensator 14, accordingly.

In this connection, it is understood that in the case of multiple main lines 5, a corresponding number of alternating valves 15 can also be provided, in order to tap the relevant load pressure for the two-way pressure compensator 14.

Likewise, depending on the concrete requirements, multiple throttles 13, pressure compensators, particularly two-way pressure compensators 14, and connection lines 40 as well as kickback valves 19 can be provided.

In this connection, it is understood that if applicable, other devices, for example two arrangements that correspond to the throttle 13 and the two-way pressure compensator 14 according to FIG. 2, can be provided as proportional volume stream control means.

Figure 4:
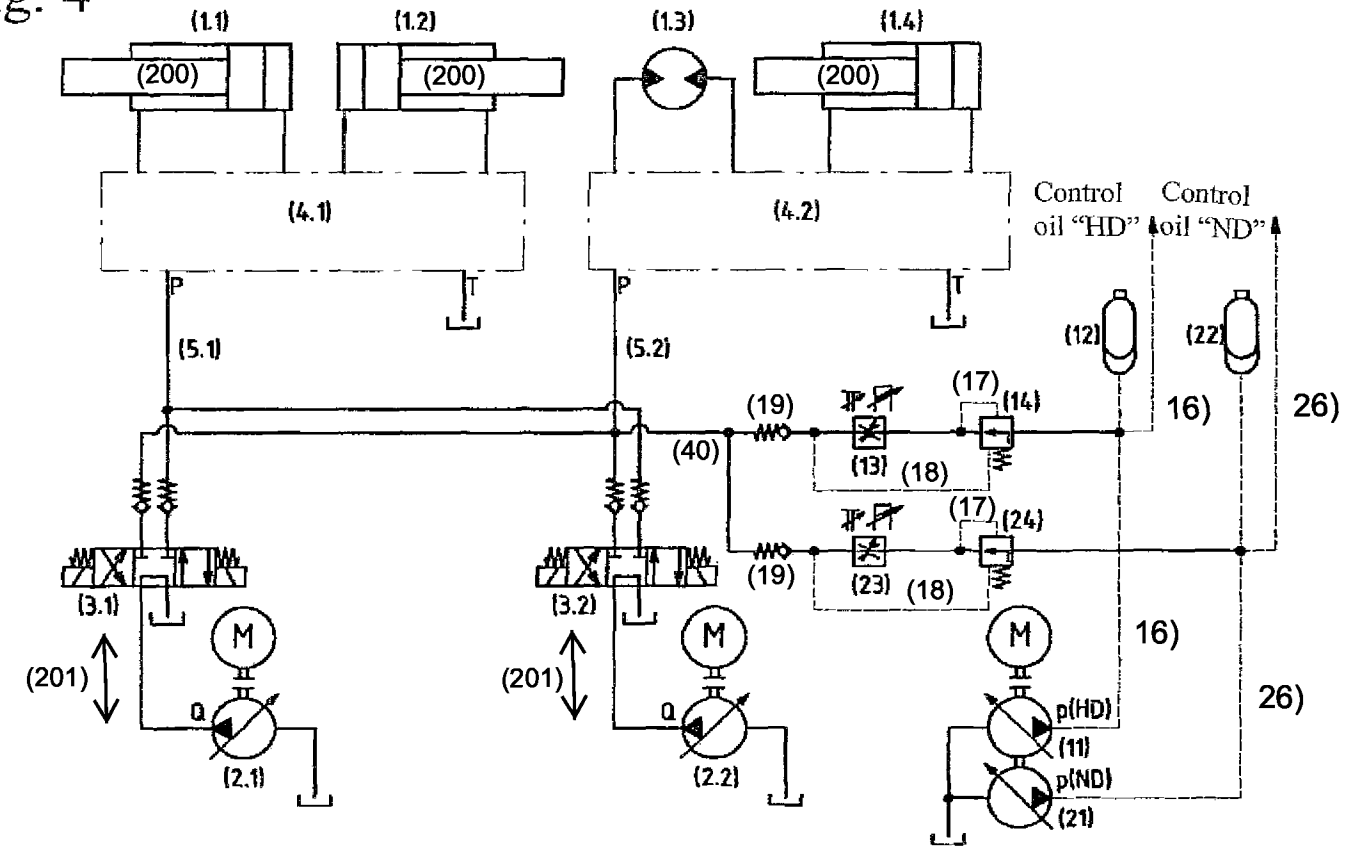
FIG. 4 a schematic representation of details of a third hydraulic system for an extrusion press essential for an explanation of the invention.

The arrangement according to FIG. 4 corresponds to the arrangement according to FIG. 2 with regard to its possibility of making control pressure available to the main lines 5, so that here, too, the control pressure can be made available merely to the second main line 5.2, whereby, however, in both exemplary embodiments hydraulic oil can be made available also to the first main line 5.1 by the second main pump 2.2, by way of the second line valve 3.2, so that accordingly, both main pumps 2 can also be used for the first consumer controller 4.1, while the control pressure or the hydraulic oil coming from the control pressure system is simultaneously available to the second consumer controller 4.2.

In deviation from the exemplary embodiment according to FIG. 2, two control pressure pumps 11 and 21 are provided, whereby the control pressure pump 11 is regulated to a high pressure (HD) and the control pressure pump 21 is regulated to a low pressure (ND). In this connection, the control pressure system with high pressure can serve for keeping valves and possible startup or tear-away pressures available, for example, while travel pressures of secondary units or valves with large displacement paths can be made available by way of the low control pressure.

The two control pressure lines 16, 26 each have hydraulic storage devices 12, 22 and are each connected with the second main line 5.2, by way of proportional volume stream control, in this exemplary embodiment consisting of a throttle 13, 23, in each instance, particularly a manual or proportional throttle, and a two-way pressure compensator 14, 24, in each instance, as well as a kickback valve 19, 19, in each instance, whereby it is understood that if applicable, a connection to the first main line 5.1 or a connection to the two main lines 5 can be provided, for example by way of the arrangement according to FIG. 3. Each two-way pressure compensator 14, 24 is connected with the connection line 40 between the two-way pressure compensator 14, 24 and the respective throttle 13, 23 on the main line side 44 of the two-way pressure compensator 14, 24 by linking lines 17, 18. Each two-way pressure compensator 14, 24 is also connected with the connection line 40 on the main line side 44 of the two-way pressure compensator 14, 24 between the respective throttle 13, 23 and the respective kickback valve 19, 19 by linking lines 17, 18. By means of the use not only of high control pressure but also low control pressure, not only great startup or tear-away pressures but also lower required travel pressures can be implemented, if necessary. In this way, lower throttle losses occur, particularly with regard to the low-pressure range, whereby in all the embodiments, the level of the required pressures must generally be taken into consideration in projecting and assigning a corresponding hydraulic extrusion press 100, in each instance. In particular, it must also be checked in what concrete sequence phases an additional movement or increase in speed leads to a reduction in the non-productive period, and how the circuit can be designed most effectively, in terms of energy. From this, the storage volume can also be determined, and, if necessary, the power of the selected control pumps can be adapted.

In the case of the arrangement shown in FIG. 4, the low-pressure region of the control pressure system is passively applied, as well, so that at high startup or tear-away loads, at first only the high-pressure region is active, but no switch-over procedures are required any longer during the further movement sequence.

Figure 5:
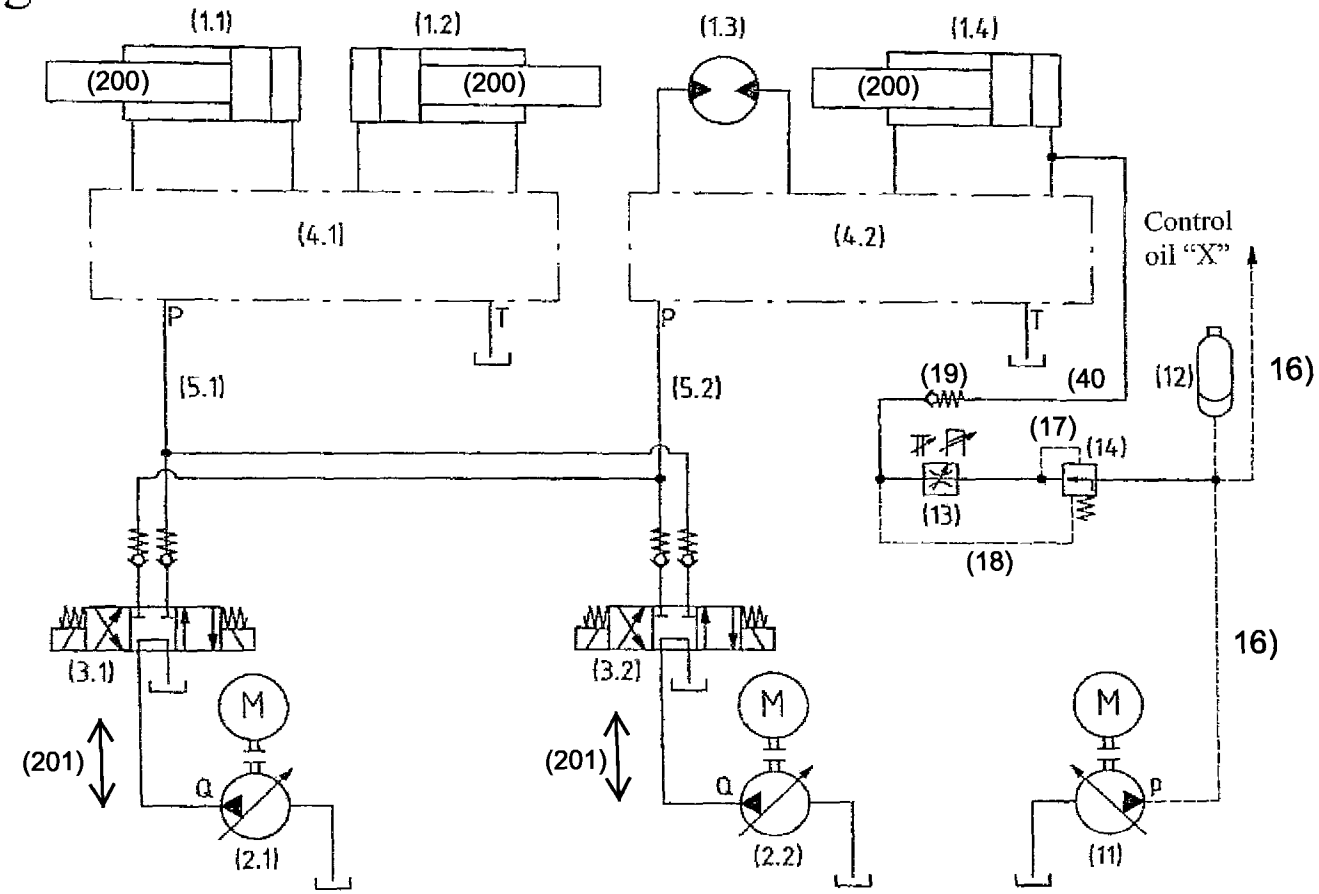
FIG. 5 a schematic representation of details of a fourth hydraulic system for an extrusion press essential for an explanation of the invention.

It is understood that the additional conveying stream made available by the control pressure pump 11 or by the control pressure can also be applied directly to a main consumer 1, as has been done as an example in the exemplary embodiment shown in FIG. 5, for the sensor cylinder 1.4. In this way, the sensor cylinder 1.4 can also be moved independently of the corresponding main line 5.2 which is connected to control line 16 by way of a connection line or of the corresponding second consumer controller 4.2. Therefore, two main consumers 1.3 and 1.4 can also easily be moved at the same time. Thus, for example, in the case of a known extrusion press, the pre-acceleration of the moving crosshead during the reverse stroke, before a sensor sets down for the travel in the "total differential" in order to take the moving crosshead along for the remainder of the stroke, can take place accordingly. Setting down then no longer has to take place at a speed close to "zero" but rather can happen on the fly, in other words at a high speed. Because braking and acceleration processes are minimized in this way, the foreseeable time saving can amount to between 0.5 and 0.8 seconds, depending on the machine type.

Figure 6:
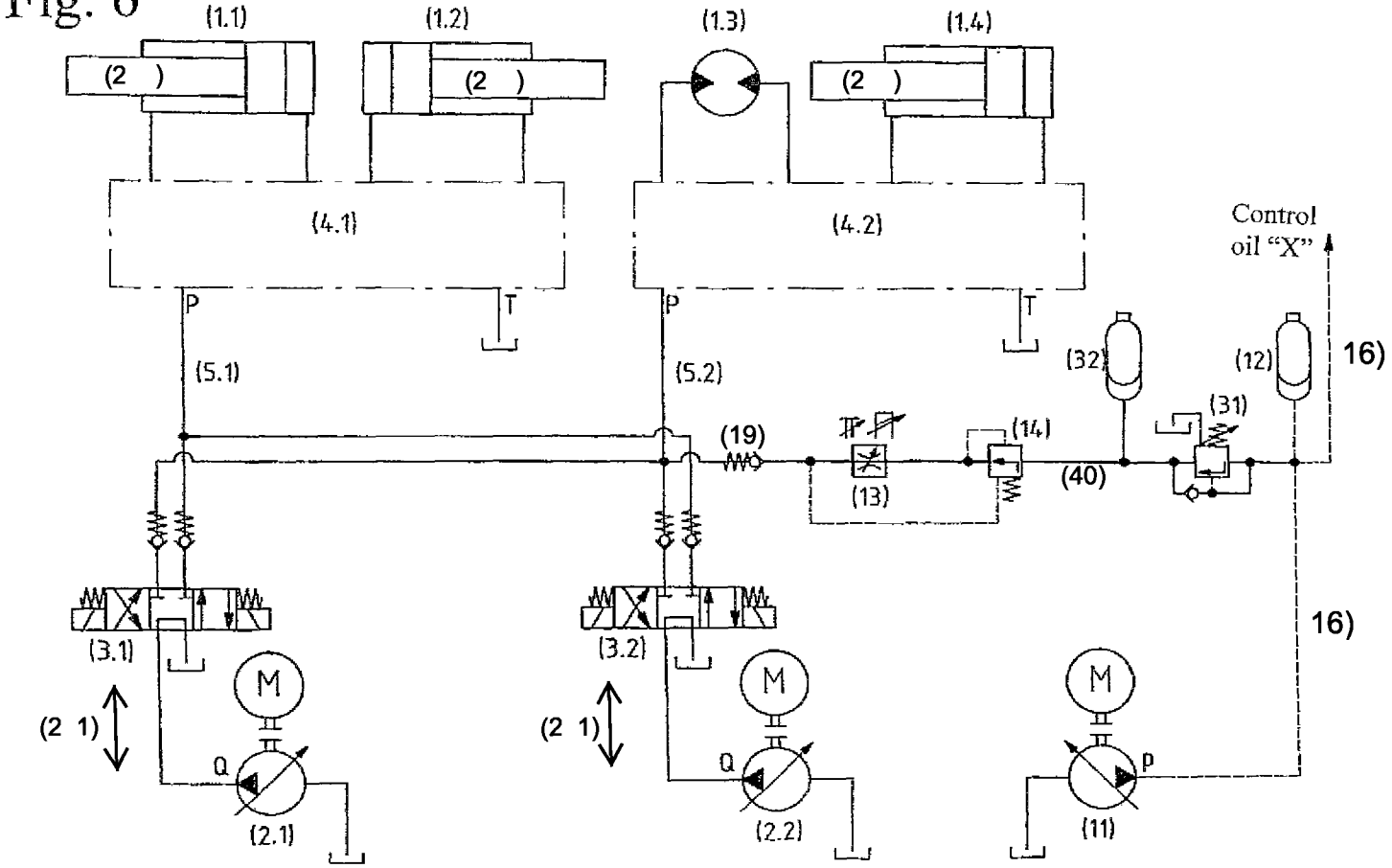
FIG. 6 a schematic representation of details of a fifth hydraulic system for an extrusion press essential for an explanation of the invention.

As is shown as an example using the exemplary embodiment according to FIG. 6, first a pressure application valve 31 and then a supplemental storage device 32 can be provided in the connection line 40 between control pressure pump 11 and main lines 5.1, 5.2, which are connected by way of the connection line 40 to the control line 16, coming from the control pressure pump 11, before the proportional volume stream control, which once again consists of a throttle 13 and a two-way pressure compensator 14 in this exemplary embodiment, then follows. In this manner, the storage device 32 is only supplied with hydraulic oil from the control pressure pump 11 when a minimum control pressure of the control pressure has been reached and is held. In this regard, the control pressure has priority as compared with a non-productive period acceleration, so that the controller is not impaired thereby. Particularly as the result of this embodiment, the useful volume of the storage device 32 can be increased downward as compared with the useful volume of the storage device 12, by means of expanding the usable pressure range, because the storage device 32 can be emptied to pressures that lie below the control pressure. In this way, the number and size of the storage devices used can be increased.

It is understood that the various embodiments explained in FIGS. 2 to 6 can also be combined, as is directly evident. This particularly holds true, for example, for the exemplary embodiment shown in FIG. 4, which can be supplementally or alternatively configured with a high-pressure and/or low-pressure region, in accordance with the exemplary embodiments shown in FIGS. 3 and/or 6. Preferably, feed of the additional volume stream 201 to the main lines 5 takes place, even if this takes place directly to a main consumer 1, if applicable, as shown as an example in FIG. 5, by way of pressure-independent flow regulation valves as a proportional volume stream control means. These generally have a throttle 13, for example implemented as a proportional valve, a proportional throttle or an electrical proportional directional valve, as well as a two-way pressure compensator 14. If the system is designed correctly, neither the actual control pressure present in the system nor the required and possibly changeable movement pressure or consumption pressure of the main consumers 1 should therefore have any influence on the through-flow amount of the flow regulation valves or the proportional volume stream control means. This in turn makes it possible for the sequences and speed to be and remain reproducible, in a manner that can be preselected.

In particular, parallel circuits as well as a great number of combination possibilities of the detail solutions explained in FIGS. 2 to 6 can be used for a concrete system design.

The invention claimed is:

1. A method for operation of a hydraulic extrusion press comprising:

providing the hydraulic extrusion press having a hydraulic control pressure system comprising a control pressure pump and at least one ram, in which at least the ram is driven via hydraulic oil from a main line comprising first and second main pumps, and a hydraulic control pressure supplied by the control pressure pump connected to the first and second main pumps is used to control the extrusion press; and operating the hydraulic extrusion press so that:

the control pressure pump makes the hydraulic control pressure available by way of control oil, the control pressure system is securable against volume streams from the main line, the control pressure system drives secondary consumers, the control pressure system drives a valve control and/or applies a release pressure, the hydraulic control pressure is also applied to the main line, and the main line and the control pressure system are connected with one another on a pressure side of the hydraulic extrusion press by way of a connection line, connecting the control pressure system with the main line by way of said connection line and proportionally controlling volume in the connection line; and proportionally controlling the volume by a throttle in said connection line.

2. The method according to claim 1, further comprising applying the hydraulic control pressure to the main line by way of proportional volume stream control.

3. The method according to claim 1, further comprising volume-regulating the main line, keeping the hydraulic control pressure above a minimum pressure, or volume-regulating the main line and keeping the hydraulic control pressure above a minimum pressure.

4. The method according to claim 1, further comprising storing hydraulic oil in a storage device and applying the hydraulic oil stored in the storage device to the main line from the storage device, by way of the hydraulic control pressure.

5. The method according to claim 4, further comprising emptying the storage device into the main line at a pressure below the hydraulic control pressure.

6. The method according to claim 4, further comprising providing the hydraulic oil from the storage device starting from a storage pressure.

7. The method according to claim 4, wherein the storage device is arranged between the control pressure pump and the throttle on the control line side of the throttle.

8. The method according to claim 1, further comprising providing a kickback valve in the connection line on a main line side of said throttle.

9. The method according to claim 1, wherein the main line is volume-regulated and the control pressure system is pressure regulated.

10. The method according to claim 1, wherein the connection line makes a volume stream available to the main line.

11. A method for operation of a hydraulic extrusion press comprising:

providing the hydraulic extrusion press having a hydraulic control pressure system comprising a control pressure pump and at least one ram, in which at least the ram is driven via hydraulic oil from a main line comprising first and second main pumps, and a hydraulic control pressure supplied by the control pressure pump connected to the first and second main pumps is used to control the extrusion press; and operating the hydraulic extrusion press so that:

the control pressure pump makes the hydraulic control pressure available by way of control oil, the control pressure system is securable against volume streams from the main line, the control pressure system drives secondary consumers, the control pressure system drives a valve control and/or applies a release pressure, the hydraulic control pressure is also applied to the main line, and the main line and the control pressure system are connected with one another on a pressure side of the hydraulic extrusion press by way of a connection line, connecting the control pressure system with the main line by way of said connection line and proportionally controlling volume in the connection line; and proportionally controlling the volume by a two-way pressure compensator in said connection line.

12. The method according to claim 11, further comprising applying the hydraulic control pressure to the main line by way of proportional volume stream control.

13. The method according to claim 11, further comprising volume-regulating the main line, keeping the hydraulic control pressure above a minimum pressure, or volume-regulating the main line and keeping the hydraulic control pressure above a minimum pressure.

14. The method according to claim 11, further comprising storing hydraulic oil in a storage device and applying the hydraulic oil stored in the storage device to the main line from the storage device, by way of the hydraulic control pressure.

15. The method according to claim 14, wherein the storage device is arranged between the control pressure pump and the two-way pressure compensator on the control line side of the two-way pressure compensator.

16. The method according to claim 11, further comprising connecting the two-way pressure compensator with the connection line on a main line side of the two-way pressure compensator by a linking line for controlling the two-way pressure compensator.

17. The method according to claim 11, further comprising proportionally controlling the volume by a throttle in said connection line.

18. The method according to claim 17, further comprising proportionally controlling the volume by said throttle in said connection line on a main line side of the two-way pressure compensator.

19. The method according to claim 18, further comprising connecting the two-way pressure compensator to a portion of the connection line extending between the two-way pressure compensator and the throttle on the main line side of said two-way pressure compensator by a linking line.

20. The method according to claim 17, further comprising providing a kickback valve in said connection line on a main line side of the two-way pressure compensator.

21. The method according to claim 20, further comprising providing the throttle in said connection line between the kickback valve and the two-way pressure compensator on the main line side of the two-way pressure compensator.

22. The method according to claim 21, further comprising connecting the two-way pressure compensator to a portion of the connection line extending between the throttle and the kickback valve on the main line side of said two-way pressure compensator by a linking line.

23. The method according to claim 17, further comprising providing the throttle in said connection line between the kickback valve and the two-way pressure compensator on a main line side of the two-way pressure compensator.

24. The method according to claim 23, further comprising connecting the two-way pressure compensator to a portion of the connection line extending between the throttle and the kickback valve on the main line side of said two-way pressure compensator by a linking line.

25. The method according to claim 11, wherein the main line is volume-regulated and the control pressure system is pressure regulated.

26. The method according to claim 11, wherein the connection line makes a volume stream available to the main line.

* * * * *